United States Patent [19]

Ashfield

[11] 4,267,807

[45] May 19, 1981

[54] INTERNAL COMBUSTION ENGINES

[75] Inventor: Herbert E. Ashfield, Huddersfield, England

[73] Assignee: David Brown Tractors Limited, Huddersfield, England

[21] Appl. No.: 55,215

[22] Filed: Jul. 6, 1979

[30] Foreign Application Priority Data

Jul. 13, 1978 [GB] United Kingdom ..... 29719/78

[51] Int. Cl.[3] ..... F02D 9/06; F02D 7/00

[52] U.S. Cl. ..... 123/323; 123/397; 123/198 D

[58] Field of Search ..... 123/323, 397, 198 D

[56] References Cited

U.S. PATENT DOCUMENTS 2,730,090 1/1956 Holl ..... 123/323

FOREIGN PATENT DOCUMENTS 40788 2/1910 Austria ..... 123/323
299198 9/1919 Fed. Rep. of Germany ..... 123/323
2505675 11/1975 Fed. Rep. of Germany ..... 123/323
1043618 6/1953 France ..... 123/323
886541 1/1962 United Kingdom ..... 123/323

*Primary Examiner*—Wendell E. Burns
*Attorney, Agent, or Firm*—Robert D. Godard

[57] ABSTRACT

A very heavy vehicle may tend to run away on a steep gradient and as a result the engine is liable to be overspeeded with consequential risk of damage especially to its valve mechanism. The invention aims to prevent overspeeding by providing a servo mechanism operable automatically above a predetermined engine speed to apply an exhaust brake. The servo mechanism preferably comprises a centrifugal clutch normally held disengaged by springs and disposed on a shaft driven by the engine. Angular movement of the driven member of the clutch due to its engagement by engine speed in excess of the predetermined value is limited to, say, 60° by a stop, and said member is mechanically linked to the operating means of the exhaust brake.

7 Claims, 3 Drawing Figures

INTERNAL COMBUSTION ENGINES

BACKGROUND OF INVENTION

The invention relates to an internal combustion engine provided with means for preventing overspeeding of the engine, said means including an exhaust brake associated with the engine.

An exhaust brake is sometimes used to supplement the wheel brakes of a very heavy vehicle when descending a steep gradient, to prevent any tendency for the vehicle to run away causing overspeeding of the engine and consequential damage thereto, for example to its valve mechanism. An exhaust brake is well known per se and comprises a valve operable to obstruct the escape of exhaust gases when the vehicle is in gear and overdriving, that is to say when the wheels are transmitting drive back to the engine. The engine is thus caused to absorb torque by functioning as a compressor.

If a very heavy vehicle does run away, the driver is suddenly required to perform a number of different operations. These include steering the safest possible course, applying the wheel brakes, almost or entirely cutting off the supply of fuel to the engine, changing into a low gear ratio, and applying the exhaust brake where one is fitted. It is difficult to carry out all these operations quickly and effectively under emergency conditions.

It has been proposed to actuate an exhaust brake automatically by electro-hydraulic means controlled by a continuously monitored engine parameter or by electrical means controlled simultaneously by two such parameters, but these proposals have been complex and therefore costly and prone to malfunction.

The object of the present invention is to provide inexpensive but reliable means for actuating an exhaust brake automatically and thus easing the task of the driver if the vehicle runs away.

SUMMARY OF INVENTION

According to the invention, in an internal combustion engine provided with means for automatically preventing overspeeding of the engine, said means include an exhaust brake associated with the engine, and a servo system operatively connected between the output side of the engine and the exhaust brake and comprising a mechanical device adapted to move rapidly through a limited distance if the engine speed exceeds a predetermined value.

The exhaust brake is accordingly applied automatically. It therefore acts promptly and without fail to prevent overspeeding of the engine and any consequential damage thereto, and also to assist in retarding the vehicle thus reducing the risk of accident and/or injury. The exhaust brake is also released automatically when it is no longer required to operate.

BRIEF DESCRIPTION OF DRAWINGS

A preferred embodiment of the invention will now be described, by way of example, with reference to the accompanying drawings of which.

DESCRIPTION OF PREFERRED EMBODIMENT

Figure 1:
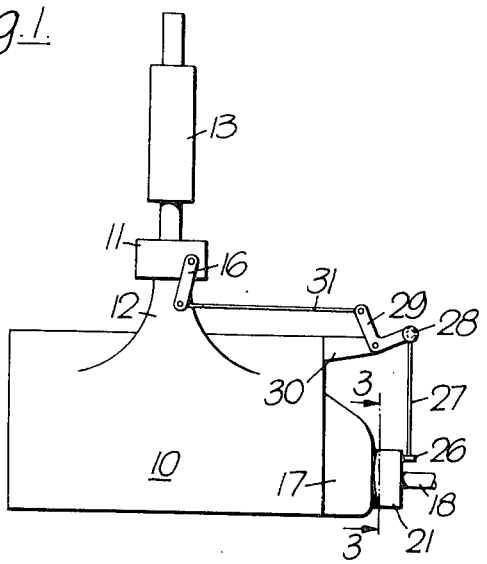
FIG. 1 is a diagrammatic side elevation of an engine.
Figure 2:
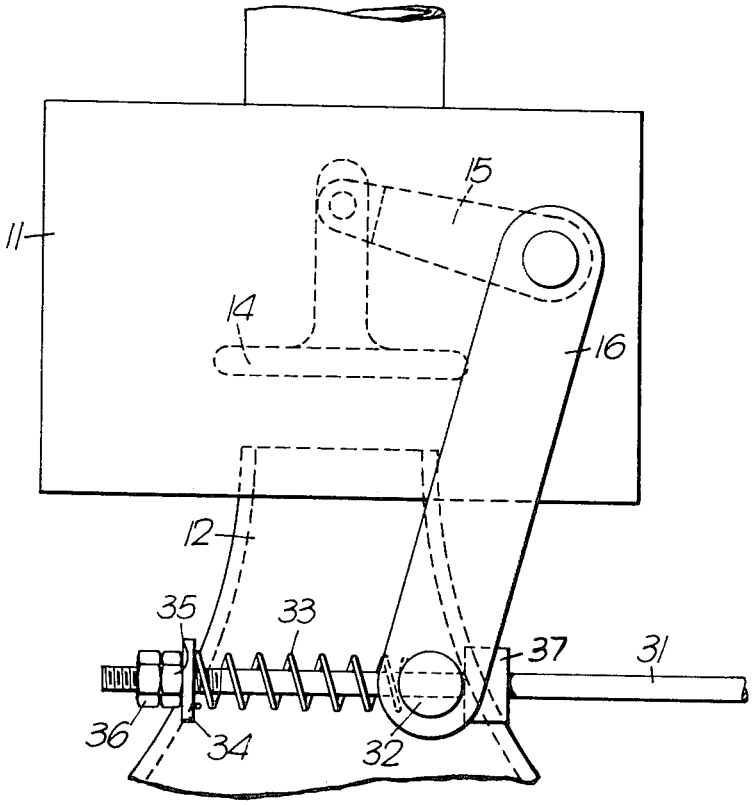
FIG. 2 is a semi-diagrammatic side elevation of an exhaust brake associated with the engine.
Figure 3:
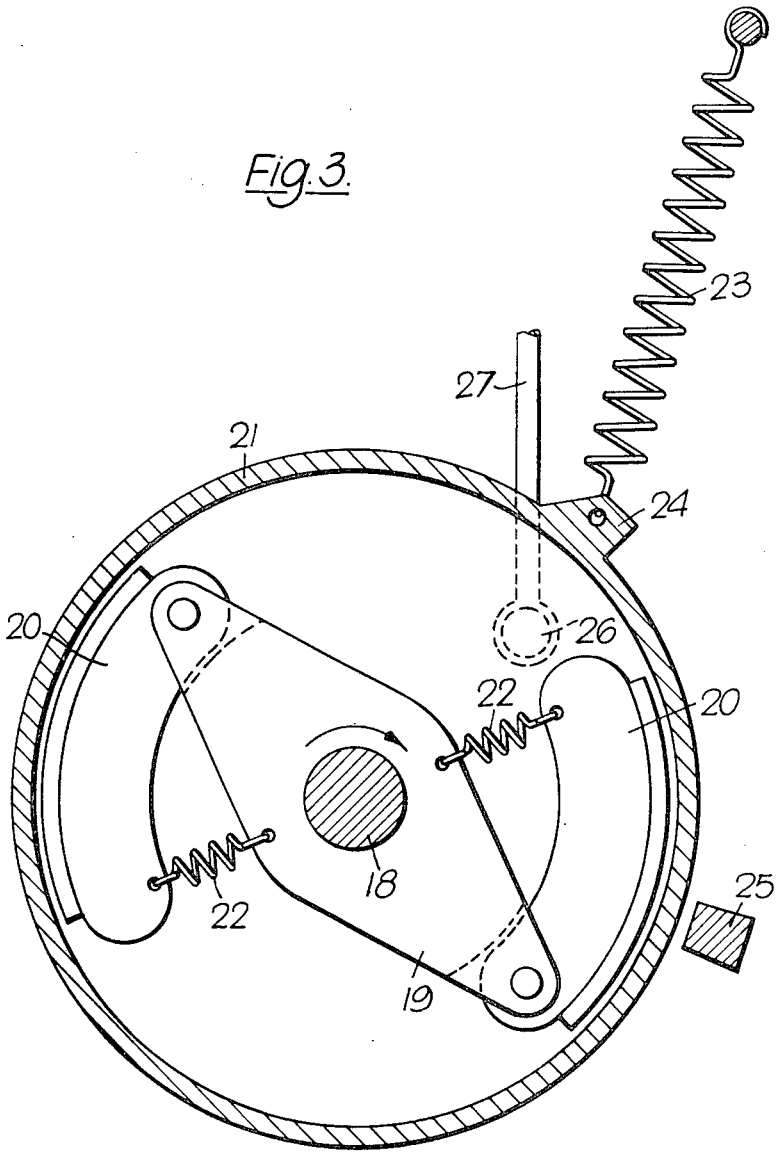
FIG. 3 is a section through a centrifugal clutch on the line 3—3 in FIG. 1.

Referring now to the drawings, all of which show the components of the invention in inoperative position, a very heavy vehicle, which may be a tractor equipped with both a front loader and a backhoe, has an engine 10 with an exhaust brake in a housing 11 disposed between its exhaust manifold 12 and its exhaust silencer 13. The exhaust brake comprises a valve 14 moveable into an operative position so as to obstruct the escape of exhaust gases by a bell-crank lever having arms 15 and 16 disposed respectively inside and outside the housing 11. The engine 10 drives the tractor through a power path including a main transmission clutch disposed within a casing 17, change-speed gearing, differential gearing and final reduction gearing. None of said gearing is shown. On the output shaft 18 of the main transmission clutch there is disposed a centrifugal clutch comprising a hub 19 rigidly secured to said shaft and carrying two shoes 20 engageable with the inner periphery of a drum 21 rotateably supported by the casing 17 of the main transmission clutch. The shoes 20 are diametrically opposite each other, and are each pivoted at one end on the hub 19 and restrained at the other end from expanding radially by a spring 22 anchored to the hub 19. The springs 22 are pre-loaded so that until the speed of the engine 10 and thus of the output shaft 18 of the main transmission clutch exceeds, say 2,500 revolutions per minute, the shoes 20 are held retracted. The drum 21 is capable of limited angular movement, against the restoring action of a spring 23, through, say, 60° after which a projection 24 on its outer periphery contacts a stop 25 on the casing 17. Linkage means operatively connecting the centrifugal clutch to the exhaust brake comprise a spigot 26 rigidly secured to the drum 21, a rod 27 pivotally connected at one end to the spigot 26 and universally connected at the other end by a ball joint 28 to one arm of a bell-crank lever 29 pivoted on a bracket 30 carried by the engine 10, and a rod 31 pivotally connected at one end to the other arm of the bell-crank lever 29 and passing slideably at the other end through a diametrical hole in a pin 32 carried rotateably by the arm 16. A spring 33 surrounding the rod 31 is pre-compressed between the pin 32 and the washer 34 by a nut 35 and a lock-nut 36. A fixed abutment 37 is provided on the rod 31 at that side of the pin remote from the spring 33.

In operation, if the engine speed exceeds 2,500 revolutions per minute the action of centrifugal force on the shoes 20 overcomes the action of their associated springs 22 and said shoes engage the drum 21, causing it to move angularly until its projection 24 contacts the stop 25 and holding it in that position by virtue of the frictional engagement between said shoes and said drum. This angular movement of the drum 21 causes the linkage means to move the valve 14 of the exhaust brake into operative position, which automatically increases the retarding force exerted by the engine 10 and thus prevents overspeeding of the engine. In order to prevent an excessive back pressure within the engine 10 forcing lubricating oil out of the engine, for example past its crankshaft bearing seals, the pre-compressed spring 33 limits the maximum exhaust gas pressure within the engine 10 by allowing the valve 14 to open when a predetermined pressure is attained. When the engine speed falls below 2,500 revolutions per minute the shoes 20 are retracted by the springs 22 out of engagement with the drum 21 and the latter is accordingly moved away from the stop 25 by the spring 23 so that the exhaust brake is automatically released. In effect, the centrifugal clutch and its associated linkage means constitute a servo system. The aforesaid frictional engagement between the shoes 20 and the drum 21 of the centrifugal clutch is not unduly detrimental as the invention is an emergency device not often rendered operative.

In a modification, the centrifugal clutch is disposed on any other suitable shaft in the afore-mentioned power path. In another modification, the linkage means constitute a cable. In a further modification, the linkage means comprise a simple hydraulic linkage. In yet another modification, the spring 33 is omitted, the rod 31 is pivotally connected to the arm 16, and a bleed hole is provided in the valve 14 to limit the back pressure within the engine 10.

I claim:

1. An internal combustion engine provided with means for automatically preventing overspeeding of the engine, said means including an exhaust brake associated with the engine, and a servo system operatively connected between the output side of the engine and the exhaust brake and comprising a mechanical device which remains completely inoperative unless the engine speed exceeds a predetermined value, whereupon said device moves rapidly through a limited distance to apply the exhaust brake suddenly and fully.

2. An internal combustion engine according to claim 1, wherein the servo system comprises a centrifugal clutch on a shaft driven by the engine, angular movement of the driven member of said clutch being limited by a stop, and linkage means connecting said member to the exhaust brake.

3. An internal combustion engine according to claim 2, wherein the centrifugal clutch is on the output shaft of a main transmission clutch driven by the engine.

4. An internal combustion engine according to claim 2, wherein the linkage means comprise a spigot secured to the driven member of the centrifugal clutch, a bell-crank lever pivoted on the engine, a rod connecting the spigot to said lever, and another rod connecting said lever to another bell-crank lever forming part of the exhaust brake and adapted to operate a valve in said brake.

5. An internal combustion engine according to claim 2, wherein means are provided to limit the back pressure set up within the engine when the exhaust brake is operative.

6. An internal combustion engine according to claim 5, wherein the means for limiting the back pressure comprises a yieldable connection in the linkage means.

7. An internal combustion engine according to claim 2, wherein the linkage means comprise a spigot secured to the driven member of the centrifugal clutch, a bell-crank lever pivoted on the engine, a rod connecting the spigot to said lever, and another rod connecting said lever to another bell-crank lever forming part of the exhaust brake and adapted to operate a valve in said brake, and wherein a yieldable connection comprising an adjustably pre-compressed spring is operatively disposed between said other rod and said other bell-crank lever.

* * * * *